US007270548B2

(12) United States Patent
Jenrich et al.

(10) Patent No.: US 7,270,548 B2
(45) Date of Patent: Sep. 18, 2007

(54) ELECTRICAL CONNECTOR AND METHOD FOR CONNECTING IT TO THE GLASS PANE OF A MOTOR VEHICLE

(75) Inventors: Andre Jenrich, Leipzig (DE); Jakob Gillian, Seeshaupt (DE)

(73) Assignee: FEW Fahrzeugelektrikwerk GmbH & Co. KG, Zwenkau (DE)

( * ) Notice: Subject to any disclaimer, the term of this patent is extended or adjusted under 35 U.S.C. 154(b) by 0 days.

(21) Appl. No.: 11/511,122

(22) Filed: Aug. 28, 2006

(65) Prior Publication Data

US 2007/0045002 A1 Mar. 1, 2007

(30) Foreign Application Priority Data

Aug. 27, 2005 (DE) ..... 10 2005 040 812

(51) Int. Cl.
*H01R 33/00* (2006.01)

(52) U.S. Cl. ..... 439/34

(58) Field of Classification Search ..... 439/34, 439/917, 521

See application file for complete search history.

(56) References Cited

U.S. PATENT DOCUMENTS 4,023,008 A * 5/1977 Durussel ..... 219/522
4,246,467 A * 1/1981 Boaz ..... 219/522
4,453,669 A * 6/1984 Karla et al. ..... 237/12.3 R
4,618,088 A * 10/1986 Karla ..... 228/124.1
4,997,396 A * 3/1991 Gold et al. ..... 439/801
5,208,444 A * 5/1993 Winter et al. ..... 219/547
5,268,700 A * 12/1993 Hirotsu et al. ..... 343/713
5,479,179 A * 12/1995 Hirotsu et al. ..... 343/713
5,543,601 A * 8/1996 Bartrug et al. ..... 219/203
5,676,562 A * 10/1997 Fukuda ..... 439/329
5,716,536 A * 2/1998 Yokoto et al. ..... 219/219
5,738,554 A * 4/1998 Borger et al. ..... 439/874
5,897,406 A * 4/1999 Benes et al. ..... 439/859
5,928,455 A * 7/1999 Dizin et al. ..... 156/276
6,103,998 A * 8/2000 Kuno et al. ..... 219/203

(Continued)

FOREIGN PATENT DOCUMENTS

DE 19640816 4/1997

(Continued)

*Primary Examiner*—Ross Gushi
(74) *Attorney, Agent, or Firm*—Jordan and Hamburg LLP

(57) ABSTRACT

An electrical connector for electrical devices such as heating panels, antennas, or the like that are provided on glass panes on motor vehicles, having at least one soldering area to be soldered onto the glass pane and having a connector area joined electrically conducting thereto, characterized in that provided is a housing that receives the soldering area and that has a lower part that is at least partially open and that is positioned against the glass pane and which housing has a cover for exteriorly closing the lower part, in that the latter has a circumferential lower and a circumferential exterior upper edge, in that provided respectively on the lower and on the upper edges are a lower and an upper water-tight double-sided adhesive tape, each having a lower or upper protective film on the side of the adhesive tape that is open to the outside, in that the connector area leads water-tight out of the housing and the thus electrically conducting joined soldering area is embodied as a solder depot that projects over the partially open area of the lower part.

11 Claims, 1 Drawing Sheet

U.S. PATENT DOCUMENTS

| | | | | |
|---|---|---|---|---|
| 6,406,337 | B1 * | 6/2002 | Machado | 439/876 |
| 6,448,350 | B1 * | 9/2002 | Dall'Occo et al. | 526/160 |
| 6,464,984 | B2 * | 10/2002 | Audonnet et al. | 424/214.1 |
| 6,521,083 | B1 * | 2/2003 | Swanson et al. | 156/380.9 |
| 6,544,043 | B1 * | 4/2003 | Smith | 439/34 |
| 6,551,150 | B2 * | 4/2003 | Machado | 439/876 |
| 6,598,931 | B2 * | 7/2003 | Tamura | 296/146.14 |
| 6,638,075 | B2 * | 10/2003 | Spaulding et al. | 439/34 |
| 6,685,514 | B2 * | 2/2004 | Costa | 439/876 |
| 6,774,342 | B2 * | 8/2004 | Capriotti et al. | 219/203 |
| 6,790,104 | B2 * | 9/2004 | Antaya et al. | 439/862 |
| 6,793,120 | B2 * | 9/2004 | Johnson | 228/122.1 |
| 6,906,287 | B2 * | 6/2005 | Sol | 219/203 |
| 7,059,884 | B2 * | 6/2006 | Hisaeda et al. | 439/329 |
| 7,134,201 | B2 * | 11/2006 | Ackerman et al. | 29/857 |
| 7,180,031 | B1 * | 2/2007 | Loibl et al. | 219/203 |
| 2001/0024175 | A1 * | 9/2001 | Takenobu | 343/713 |
| 2003/0042239 | A1 * | 3/2003 | Sol | 219/203 |
| 2004/0095284 | A1 * | 5/2004 | Mueller et al. | 343/713 |
| 2004/0178961 | A1 * | 9/2004 | Maeuser et al. | 343/713 |
| 2006/0105589 | A1 * | 5/2006 | Ackerman et al. | 439/34 |
| 2006/0174476 | A1 * | 8/2006 | Loibl | 29/611 |
| 2006/0234523 | A1 * | 10/2006 | Baranski et al. | 439/67 |

FOREIGN PATENT DOCUMENTS

| | | |
|---|---|---|
| DE | 10147908 | 5/2003 |
| JP | 2004 032437 | 1/2004 |

* cited by examiner

ELECTRICAL CONNECTOR AND METHOD FOR CONNECTING IT TO THE GLASS PANE OF A MOTOR VEHICLE

BACKGROUND OF THE INVENTION

The invention relates to an electrical connector for electrical devices, such as heating panels, antennas, or the like that are provided on glass panes on motor vehicles, having a soldering area to be soldered onto the glass pane and having a connector area joined electrically conducting thereto. The invention furthermore relates to a method for producing a connector that is securely joined to the glass pane of a motor vehicle, which glass pane is provided with electrical devices such as heating panels, antennas, or the like.

Glass panes in motor vehicles today have a number of additional electrical devices such as an antenna, glass pane heater, and the like. The electrical connectors are attached before the glass pane is installed in the motor vehicle. This occurs in that a solder pad provided with solder is placed on the contact surface of the glass pane and is then heated so that the solder melts and with the contact surface is joined to the glass pane. In addition, a housing must then be placed on this area and must subsequently be sealed by means of applying a heat-sealing adhesive to prevent water from penetrating.

Attaching the housing and its electrical connector is complicated and the subsequent sealing to prevent water from penetrating e.g. by means of a heat-sealing adhesive is inconvenient.

The underlying object of the invention is therefore to suggest an electrical connector and a method for attaching the latter to the glass pane of motor vehicles that is less complex and inconvenient.

SUMMARY OF THE INVENTION

This object is inventively attained in a generic electrical connector in accordance with the preamble to the main claim using its characterizing features, that is, in that provided is a housing that receives the soldering area and that has a lower part that is at least partially open and that is positioned against the glass pane and which housing has a cover for exteriorly closing the lower part, in that the latter has a circumferential lower and a circumferential exterior upper edge, in that provided respectively on the lower and on the upper edges are a lower and an upper water-tight double-sided adhesive tape, each having a lower or upper protective film on the side of the adhesive tape that is open to the outside, in that the connector area leads water-tight out of the housing and the thus electrically conducting joined soldering area is embodied as a solder depot that projects over the partially open area of the lower part, and in a method is attained in that first the lower protective film on the lower double-sided adhesive tape is removed, then the pre-assembled housing is pressed onto the glass pane at a contact surface with the solder depot and securely glued thereto, then the solder carrier(s) and/or the solder depot is/are heated, melting the solder depot, and finally the upper protective film on the upper double-sided adhesive tape is removed and the cover is placed onto the housing.

Thus, precise positioning of the connector with the solder depot at the contact point on the glass pane and soldering to the glass of the glass pane and the water-tight protection are inventively effected in one work step.

Further useful embodiments and further developments of the invention are characterized in the subordinate claims.

One exemplary embodiment of the invention is explained in greater detail in the following using the drawings.

DETAILED DESCRIPTION OF THE INVENTION

Figure 1:
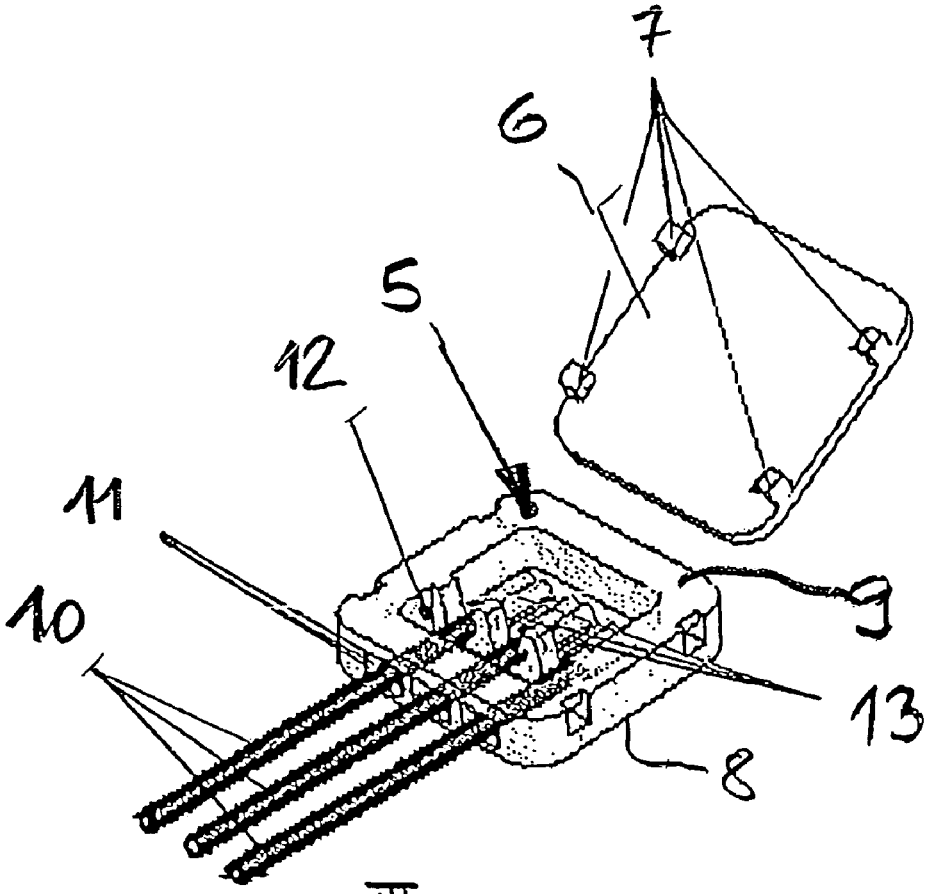
FIG. 1 is a schematic perspective depiction of the electrical connector.
Figure 2:
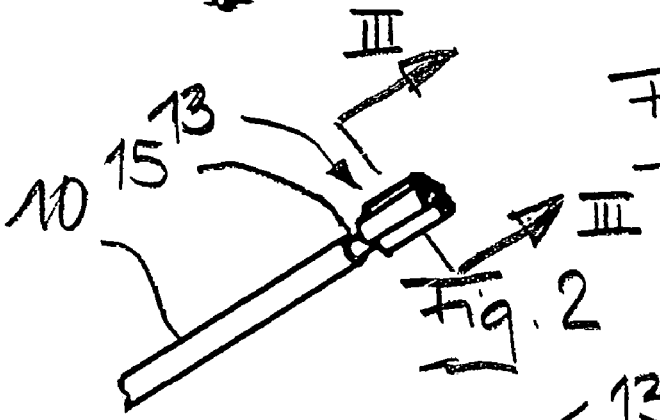
FIG. 2 is a perspective depiction of the electrical connector line.
Figure 3:
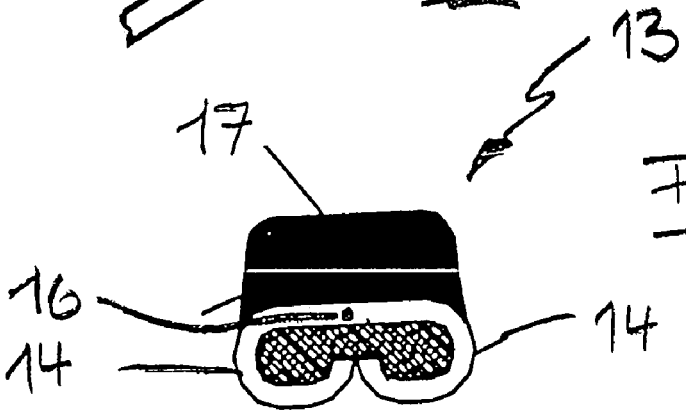
FIG. 3 is a schematic perspective depiction of the lead-end sleeve.

The electrical connector is for soldering to electrical devices such as heating panels, antennas, or the like that are provided on the glass panes of motor vehicles and has at least one soldering area to be soldered to the glass pane and for each soldering area has one electrically conducting joined connector area.

For this, a housing is provided that receives the soldering area and that has a lower part 5 that is at least partially open and that is for positioning against the glass pane and the housing is provided a cover 6 for exteriorly sealing the lower part that has snap-in catches 7 that lock into place in corresponding recesses in the lower part 5.

The lower part 5 furthermore has a circumferential lower edge 8 and a circumferential exterior upper edge 9 on which (lower and upper edges) is respectively one lower and one upper water-tight double-sided adhesive tape (not shown), each respectively having lower and upper protective film (also not shown) on the side of the adhesive tape that is open to the outside.

The connector area having at least one solder connector in the form of electrical connector lines 10 leads water-tight out of the housing via the openings 11 in the lower part 5, which for this purpose has a receiving area filled with a sealing mass 12, e.g. silicone rubber, so that said area together with the electrical connector line 10 is sealed from the exterior.

At its end located in the interior of the lower part 5, each electrical connector line 10 of the connector area is provided with a solder carrier embodied as a lead-end sleeve 13. The cross-section of this lead-end sleeve 13 is largely a B-shape, whereby the two curves 14 in the B are crimped onto the ends 15 of the electrical connector line 10 disposed in the interior of the lower part 5 and a largely rectangular solder depot 17 is applied, e.g. soldered, to the leg 16 of the B. In the area of the soldering area the lower part 5 is embodied open below across the lower edge 8, over which the solder depot 17 projects.

The invention claimed is:

1. Electrical connector for electrical devices, the electrical connector comprising a housing comprised of a housing body encompassing a soldering area at which solder is to be soldered to a glass pane and a connector area electrically conductively joined to the soldering area, the housing body including a portion at least partially open at the soldering area, solder contained in the housing and extending over the partially open portion of the housing body, the housing further comprising a cover for a side of the housing body opposite the partially open portion, the housing body including lower edges for facing the pane of glass and upper edges remote therefrom, respective first and second water-tight double-sided adhesive tapes adhered to the respective lower and upper edges for water-tight sealing of the housing, respective protective films covering the side of the respective tapes not adhered to the housing body, whereby, when the protective films are removed and the cover is assembled with the housing body and the lower edges of the housing body is adhered to a glass pane, the housing with the glass pane forms a water-tight enclosure.

2. Electrical connector according to claim 1, further comprising at least one solder terminal in the soldering area.

3. Electrical connector according to claim 2, further comprising an electrical connector line connected to the solder terminal.

4. Electrical connector according to claim 3, wherein the electrical connector line is an electrical connector pin.

5. Electrical connector according to claim 3, wherein the electrical connector line is an electrical cord.

6. Electrical connector according to claim 3, wherein an end of the electrical connector line at the connector is comprised of copper.

7. Electrical connector according to claim 3, wherein the solder comprises a solder sleeve on an end of the electrical connector line at the connector area.

8. Electrical connector according to claim 7, wherein the solder sleeve is crimped onto the end of the electrical line.

9. Electrical connector according to claim 1, further comprising apertures in the housing body for electrical connector lines to be received in the connector area and a sealant in the housing for water-tight sealing of the apertures.

10. Electrical connector according to claim 9, wherein the sealant comprises silicone rubber.

11. Method of securely connecting an electrical connector according to claim 1 to a glass pane, comprising removing the protective film from the first double-sided adhesive tape, pressing the lower edges of the housing body against the glass pane thereby to adhere the housing body to the glass pane, heating and melting the solder, removing the protective film from the second double-sided adhesive tape, and closing the housing body by pressing the cover onto the upper edges of the housing body thereby to adhere the cover to the housing body.

* * * * *